US010512303B2

(12) United States Patent
Ramsay et al.

(10) Patent No.: US 10,512,303 B2
(45) Date of Patent: Dec. 24, 2019

(54) HINGED REMOVABLE FOOTWEAR TONGUE

(71) Applicant: NIKE, Inc., Beaverton, OR (US)

(72) Inventors: Richard S. Ramsay, Portland, OR (US); Dustin V. Tolliver, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/810,640

(22) Filed: Nov. 13, 2017

(65) Prior Publication Data

US 2019/0142112 A1 May 16, 2019

(51) Int. Cl.

| | |
|---|---|
| ***A43B 23/26*** | (2006.01) |
| ***A43B 3/24*** | (2006.01) |
| ***A43B 23/02*** | (2006.01) |
| ***A43C 1/04*** | (2006.01) |

(52) U.S. Cl.

CPC ..... *A43B 23/26* (2013.01); *A43B 3/24* (2013.01); *A43B 23/0245* (2013.01); *A43B 23/0295* (2013.01); *A43C 1/04* (2013.01)

(58) Field of Classification Search

CPC ..... A43B 23/26; A43B 23/0245; A43B 3/24; A43C 1/04

USPC ..... 36/54, 101

See application file for complete search history.

(56) References Cited

U.S. PATENT DOCUMENTS

| | | | | |
|---|---|---|---|---|
| 39,163 | A * | 7/1863 | Newton | A43C 7/00 24/712 |
| 2,069,964 | A * | 2/1937 | Miller | A43B 23/26 2/245 |
| 2,438,711 | A * | 3/1948 | Leach | A43B 3/24 12/142 A |
| 2,551,723 | A * | 5/1951 | Camero | A43B 3/126 36/11.5 |
| 2,632,260 | A * | 3/1953 | Herceg | A43B 3/0078 36/54 |
| 2,883,771 | A | 4/1959 | Sanchez | |
| 3,299,543 | A * | 1/1967 | Merritt | A43B 23/26 24/713.4 |

(Continued)

FOREIGN PATENT DOCUMENTS

| | | |
|---|---|---|
| CN | 203341106 U | 12/2013 |
| GB | 197137 A | 5/1923 |

OTHER PUBLICATIONS

The Next Nike Kobe AD NXT Releases Next Week, May 4, 2017, https://sneakernews.com/2017/05/04/nike-kobe-ad-nxt-white-black-release-date/ (website accessed on Nov. 11, 2017).

*Primary Examiner* — Ted Kavanaugh
(74) *Attorney, Agent, or Firm* — Quinn IP Law

(57) ABSTRACT

An article of footwear includes a footwear component that is a tongue removably attachable to an upper. The tongue has a first set of lace guides extending outward of a perimeter of the tongue. The upper has a second set of lace guides. The first set of lace guides is interleaved with the second set of lace guides when the tongue is positioned adjacent the upper. The tongue is removably attached to the upper by a lace routed through the first set of lace guides and the second set of lace guides such that the tongue is hinged to the upper at the first set of lace guides and the second set of lace guides. The tongue may be reversibly, removably attached to the upper. A footwear system includes alternately removably attachable tongues.

18 Claims, 12 Drawing Sheets

(56) References Cited

U.S. PATENT DOCUMENTS 4,053,995 A * 10/1977 Shein ..... A43B 7/14 36/30 R
4,553,342 A * 11/1985 Derderian ..... A43C 1/00 24/712
4,805,321 A 2/1989 Tonkel
5,181,331 A 1/1993 Berger
5,341,583 A * 8/1994 Hallenbeck ..... A43C 11/00 36/50.1
5,371,957 A 12/1994 Gaudio
5,459,947 A 10/1995 Lasher
5,564,203 A * 10/1996 Morris ..... A43B 23/22 36/136
6,148,544 A 11/2000 Keen et al.
6,408,542 B1 * 6/2002 Shepherd ..... A43B 5/00 36/114
6,931,766 B2 * 8/2005 Greene ..... A43B 3/122 36/100
7,685,739 B2 3/2010 Aveni et al.
7,765,721 B2 8/2010 Hentz, III et al.
7,941,943 B2 * 5/2011 Baker ..... A43B 5/02 36/133
7,975,403 B2 7/2011 Mosher
8,051,585 B2 11/2011 Hope et al.
8,065,821 B1 11/2011 Reid
8,959,803 B2 2/2015 Pelletier, Jr. et al.
9,706,812 B2 7/2017 Hyde et al.
2002/0029494 A1 * 3/2002 Small ..... A43B 3/0078 36/54
2002/0029496 A1 * 3/2002 Morle ..... A43B 5/02 36/99
2002/0144434 A1 10/2002 Farys et al.
2005/0022427 A1 * 2/2005 Kerns ..... A43B 5/14 36/50.1
2007/0227045 A1 * 10/2007 Aveni ..... A43B 3/24 36/54
2016/0106183 A1 4/2016 Roberson
2016/0227871 A1 8/2016 Pitman
2017/0202310 A1 * 7/2017 Spanks ..... A43B 3/101

* cited by examiner

HINGED REMOVABLE FOOTWEAR TONGUE

TECHNICAL FIELD

The present teachings generally include a footwear tongue, an article of footwear, and a footwear system.

BACKGROUND

An article of footwear may include an upper configured to go over and/or around a wearer's foot, and a sole structure coupled to the upper to space the wearer's foot above the ground. In addition, the footwear may include a lace for adjusting the upper to the wearer's foot. The lace may be connected to the upper in order to allow the wearer to tighten the upper.

DESCRIPTION

Figure 1:
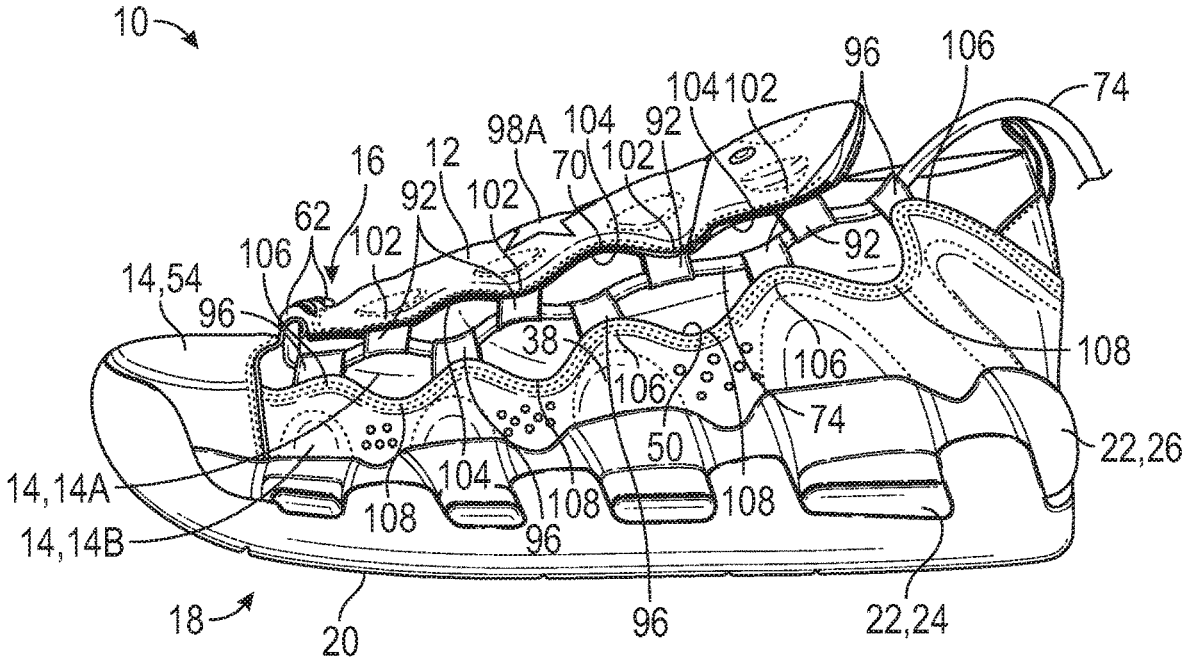
FIG. 1 is a lateral side view of an article of footwear having a tongue removably attached to an upper.

An article of footwear is provided with a tongue that is removably attachable to an upper. The removability of the tongue allows for customization of the footwear in a variety of ways described herein. For example, the tongue may be reversible. Still further, different tongues to be selected by a wearer for alternate attachment to the upper. Different tongues may be selected that have different characteristics, such as different aesthetic or functional features. Additionally, the construction of the removably attachable tongue and the upper may enhance ease of entry of a foot into a foot-receiving cavity of the article of footwear.

In one aspect of the disclosure, an article of footwear comprises a tongue and an upper. The tongue has a first set of lace guides extending outward of a perimeter of the tongue. The upper has a second set of lace guides. The first set of lace guides is interleaved with the second set of lace guides when the tongue is positioned adjacent the upper. The tongue is removably attached to the upper by a lace routed through the first set of lace guides and the second set of lace guides such that the tongue is hinged to the upper at the first set of lace guides and the second set of lace guides.

The tongue may have a perimeter with a first side edge, a second side edge, and a front edge. The upper may have a medial side, a lateral side, and a front portion. The first set of lace guides may extend outward of the front edge of the tongue, and the second set of lace guides may extend from the front portion of the upper.

The first set of lace guides and the second set of lace guides may be tubular loops each having a central opening extending parallel to the front edge of the tongue.

A first set of medial lace guides may extend outward of the first side edge of the tongue, and a first set of lateral lace guides may extend outward of the second side edge of the tongue. A second set of medial lace guides may extend from the medial side of the upper and may be interleaved with the first set of medial lace guides. A second set of lateral lace guides may extend from the lateral side of the upper and may be interleaved with the first set of lateral lace guides.

The tongue may be further removably attached to the upper by the lace when the lace is routed through the interleaved first and second sets of medial lace guides, and through the interleaved first and second sets of lateral lace guides. Due to the positions of the interleaved sets of lace guides, the lace may secure the tongue to the upper without crossing from the first set of medial lace guides and the second set of medial lace guides to the first set of lateral lace guides and the second set of lateral lace guides. Accordingly, with the exception of openings through the tongue that may be provided, the lace can extend only along the edges of the tongue, and does not cover any portion of the outer surface of the tongue between the medial and lateral lace guides. Images on the tongue are thus not obscured by the lace.

The tongue may have alternating peaks and valleys at the first side edge of the tongue, and alternating peaks and valleys at the second side edge of the tongue. The first set of medial lace guides may extend from the peaks of the first side edge of the tongue, and the first set of lateral lace guides may extend from the peaks of the second side edge of the tongue. The upper may have alternating peaks and valleys at the medial side of the upper, and alternating peaks and valleys at the lateral side of the upper. The second set of medial lace guides may extend from the peaks of the medial side of the upper. The second set of lateral lace guides may extend from the peaks of the lateral side of the upper.

The second set of medial lace guides may align with the valleys at the first side edge of the tongue. The first set of medial lace guides may align with the valleys at the medial side of the upper. The second set of lateral lace guides may align with the valleys at the second side edge of the tongue. The first set of lateral lace guides may align with the valleys at the lateral side of the upper. This enables the first set of medial lace guides to be closer to the second set of medial lace guides, and the first set of lateral lace guides to be closer to the second set of lateral lace guides, and the lace can extend more linearly through the interleaved first and second sets of medial lace guides, and more linearly through the interleaved first and second sets of lateral lace guides.

Some or all of the lace guides may be constructed as unitary with the tongue such that they are portions of a one-piece component with the tongue. Some or all of the lace guides may instead be discrete separate components that are secured to the tongue. For example, the lace guides of the first set and the tongue may be one-piece, and the lace guides of the second set may be integral portions of the upper, while the first set of medial lace guides and the first set of lateral lace guides may be discrete loops secured to the tongue.

The tongue may have a pair of lace openings extending through the tongue from an inner side of the tongue to an outer side of the tongue. A first end of the lace may extend through a first opening of the pair and a second end of the lace may extend through a second opening of the pair. The ends may be tied together after extending through the tongue. At these openings, the tied lace may obscure the outer surface of the tongue, but at the lace guides, the lace needs to cross over the tongue.

The tongue may be reversible such that a first side of the tongue is exposed when the tongue is removably attached to the upper in a first orientation, and a second side of the tongue opposite from the first side of the tongue is exposed when the tongue is removably attached to the upper in a second orientation. For example, the first and second sets of lace guides may be configured so that they are interleaved both when a first side of the tongue is exposed as an outer surface, and when an opposite second side of the tongue is instead exposed as an outer surface.

The removability of the tongue allows different tongues to be selected for attachment to the upper to achieve different aesthetics or functionality. For example, the tongue may be a first tongue, and the article of footwear may further comprise a second tongue that has at least one characteristic different than that of the first tongue, such as but not limited to a different image, color, texture, or material. The second tongue is removably attachable to the upper alternatively to the first tongue. For example, the article of footwear including the first tongue and the second tongue may be a footwear system enabling alternate use of the first tongue or the second tongue by the alternate removable attachment to the upper.

In another aspect of the disclosure, a footwear component comprises a tongue having one or more lace guides extending outward of a perimeter of the tongue at a first side edge of the tongue, at a second side edge of the tongue, or at a forward edge of the tongue, the forward edge being between the first side edge and the second side edge.

The one or more lace guides may include two lace guides spaced apart from one another such that a gap exists along the perimeter of the tongue between the two lace guides.

The one or more lace guides may extend outward of the forward edge of the tongue, and footwear component may further comprise first side lace guides extending outward of the first side edge of the tongue, and second side lace guides extending outward of the second side edge of the tongue.

The tongue may have alternating peaks and valleys at the first side edge of the tongue, and alternating peaks and valleys at the second side edge of the tongue. The first side lace guides may extend from the peaks of the first side edge of the tongue, and the second side lace guides may extend from the peaks of the second side edge of the tongue.

The tongue may have a pair of lace openings extending through the tongue from a first side of the tongue to a second side of the tongue opposite from the first side.

The tongue may have a first side and a second side opposite from the first side. The first side may have at least one of an image, color, texture, or material different than that of the second side.

In another aspect, a footwear system comprises a first tongue and a second tongue, each having a perimeter with a first set of lace guides extending outward of the perimeter. The first tongue and the second tongue have at least one different characteristic. The footwear system further comprises an upper having a second set of lace guides. The first tongue and the second tongue alternately fit adjacent the upper with the first set of lace guides interleaved with the second set of lace guides. Each of the first tongue and the second tongue is alternately removably attachable to the upper by a lace routed through the first set of lace guides and the second set of lace guides, and is removable from the upper by withdrawing the lace from the first set of lace guides and the second set of lace guides.

The perimeter of each of the first tongue and the second tongue of the footwear system may have a first side edge, a second side edge, and a front edge. The first set of lace guides may extend outward of the front edge of the tongue. The upper may have a medial side, a lateral side, and a front portion. The second set of lace guides may extend from the front portion of the upper.

Each of the first tongue and the second tongue of the footwear system may further comprise a first set of medial lace guides extending outward of the first side edge of the tongue, and a first set of lateral lace guides extending outward of the second side edge of the tongue. The upper may further comprise a second set of medial lace guides extending from the medial side of the upper and interleaved with the first set of medial lace guides when the tongue is disposed adjacent to the upper, and a second set of lateral lace guides extending from the lateral side of the upper and interleaved with the first set of lateral lace guides when the tongue is disposed adjacent to the upper. The tongue may be further removably attachable to the upper by the lace being routed through the first and second sets of medial lace guides, and through the first and second sets of lateral lace guides.

The above features and advantages and other features and advantages of the present teachings are readily apparent from the following detailed description of the modes for carrying out the present teachings when taken in connection with the accompanying drawings.

"A", "an", "the", "at least one", and "one or more" are used interchangeably to indicate that at least one of the items is present. A plurality of such items may be present unless the context clearly indicates otherwise. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., are used descriptively relative to the figures, and do not represent limitations on the scope of the invention, as defined by the claims.

Referring to the drawings, wherein like reference numbers refer to like components throughout the views, FIGS. 1-6 show an article of footwear 10 that includes a tongue 12 that is removably attachable to an upper 14 via a hinged connection 16. As described herein, the ability to completely detach the tongue 12 from the upper 14 enables different tongues to be selectively removably attached to the upper 14, or the same tongue 12 to be reversed, so that either of two opposite sides of the tongue may be exposed. The construction of the removably attachable tongue 12 and upper 14 enables a wearer to customize the footwear 10. For example, the wearer can choose to switch between and removably attach to the upper 14 any one of a set of different available tongues having different characteristics, such as a different image, color, texture, or material. Additionally, the construction of the removably attachable tongue 12 and the upper 14, and specifically the hinged connection therebetween, may enhance ease of entry of a foot into the foot-receiving cavity 30 as further explained herein.

By way of non-limiting example, within the scope of the disclosure, a "characteristic" of the tongue 12 may be one of an aesthetic characteristic, including an image, a performance characteristic, a dimensional characteristic, a material, or a physical property. Examples of an aesthetic characteristic include an image, such as a number, a picture, a name, or other text, or a color. As used herein, an "image" may comprise one or more of numbers, letters, pictorial representations, and patterns, and may be created by one or more colored mediums that may have multiple colors, or contrasting textures.

Referring to FIG. 1, the article of footwear 10 includes a sole structure 18 that underlies the upper 14. The sole structure 18 of the article of footwear 10 may have any configuration within the scope of the present teachings. As shown, the sole structure 18 includes an outsole 20, and a midsole 22 with one or more midsole layers. For example, the midsole 22 includes a fluid-filled chamber 24, in which the fluid may be gas and which is also referred to as an airbag. The midsole 22 also includes an overlying midsole layer 26 that may be formed from a variety of materials, such as a compressible polymer foam (e.g., a polyurethane or ethylvinylacetate foam). The midsole 22 attenuates ground reaction forces (i.e., provides cushioning) when compressed between the foot and the ground during walking, running, or other ambulatory activities. In further configurations, the sole structure 18 may incorporate plates, moderators, or other elements that further attenuate forces, enhance stability, or influence the motions of the foot. The outsole 20 is shown as a unitary, one-piece component, but may include discrete outsole elements, and may be of a wear-resistant material, such as rubber, that may be textured to impart traction, and/or traction elements such as tread elements or cleats may be secured to a bottom surface of the outsole 20. In another example, the sole structure 18 may be a unitary, one-piece midsole and outsole.

Figure 2:
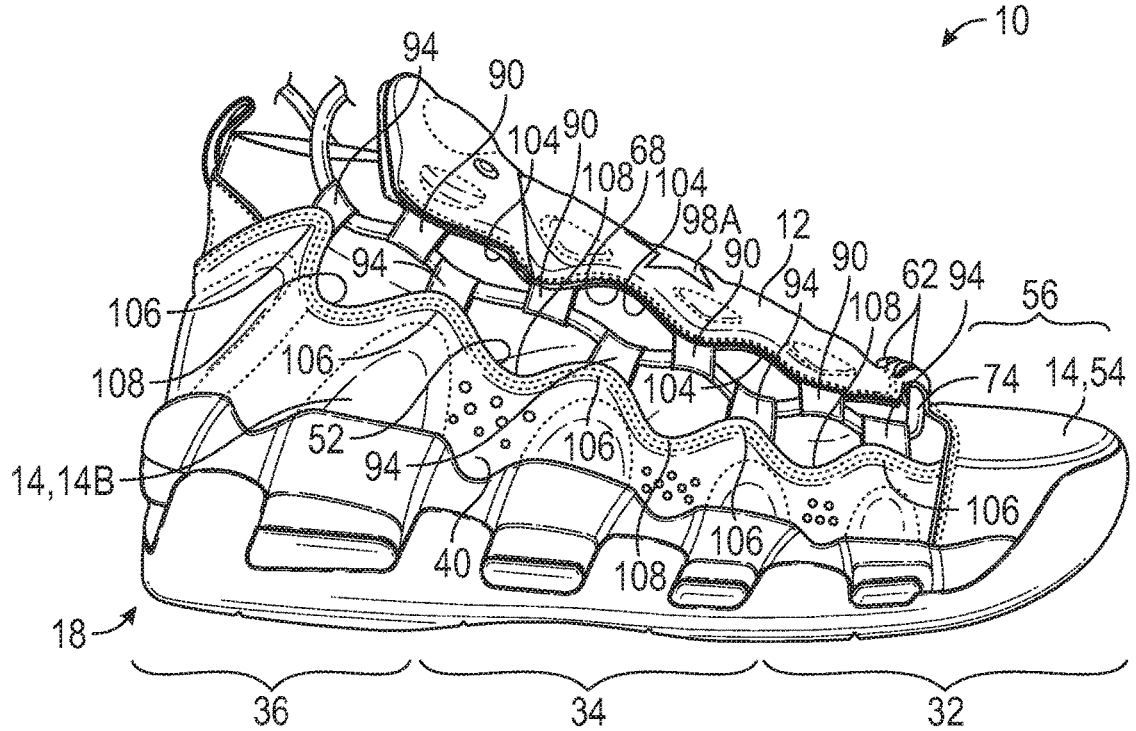
FIG. 2 is a medial side view of the article of footwear of FIG. 1.

The upper 14 is secured to the sole structure 18. For example, a lower extremity of the upper 14 may be bonded or otherwise secured to the sole structure 18 as shown in FIGS. 1 and 2. The upper 14 and the sole structure 18 together define a foot-receiving cavity 30, best shown in FIG. 3. The upper 14 is configured to receive and retain a foot in the foot-receiving cavity 30 so that the foot is supported on the sole structure 18 with the sole structure 18 positioned below the foot, and between the foot and the ground. In other embodiments, a strobel (not shown) may be secured to the lower extremity of the upper 14 and to the sole structure 18, or the upper 14 may continue under the foot-receiving cavity 30 in a sock configuration. An insole (not shown) may overlie the sole structure 18 within the foot-receiving cavity 30.

The article of footwear 10 has a forefoot region 32, a midfoot region 34 and a heel region 36. Both the upper 14 and the sole structure 18 extend in and partially define the forefoot region 32, the midfoot region 34 and the heel region 36 indicated in FIG. 2. The article of footwear 10 has a lateral side 38 (shown in FIG. 1) and a medial side 40 (shown in FIG. 2) opposite from the lateral side 38. The lateral side 38 and the medial side 40 extend through each of forefoot region 32, the midfoot region 34, and the heel region 36 and correspond with opposite sides of the article of footwear 10. The forefoot region 32, the midfoot region 34, and the heel region 36 are not intended to demarcate precise areas of footwear 10, but are instead intended to represent general areas of the article footwear 10 to aid in the discussion. The article of footwear 10 shown is configured for a left foot. An article of footwear for a right foot has a mirror image of that shown, and is within the scope of the present teachings.

The upper 14 may be a variety of materials, such as leather, textiles, polymers, cotton, foam, composites, etc. In non-limiting examples, the upper 14 may be a polymeric material capable of providing elasticity to the upper 14 and may be of braided construction, a knitted (e.g., warp-knitted) construction or a woven construction. As shown, the upper 14 includes multiple layers. More specifically, the upper 14 includes an inner layer 14A, and an outer layer 14B. The inner layer 14A is a soft, flexible material that is proximal to the foot. The outer layer 14B provides additional support, and may be stiffer than the inner layer 14A.

Figure 3:
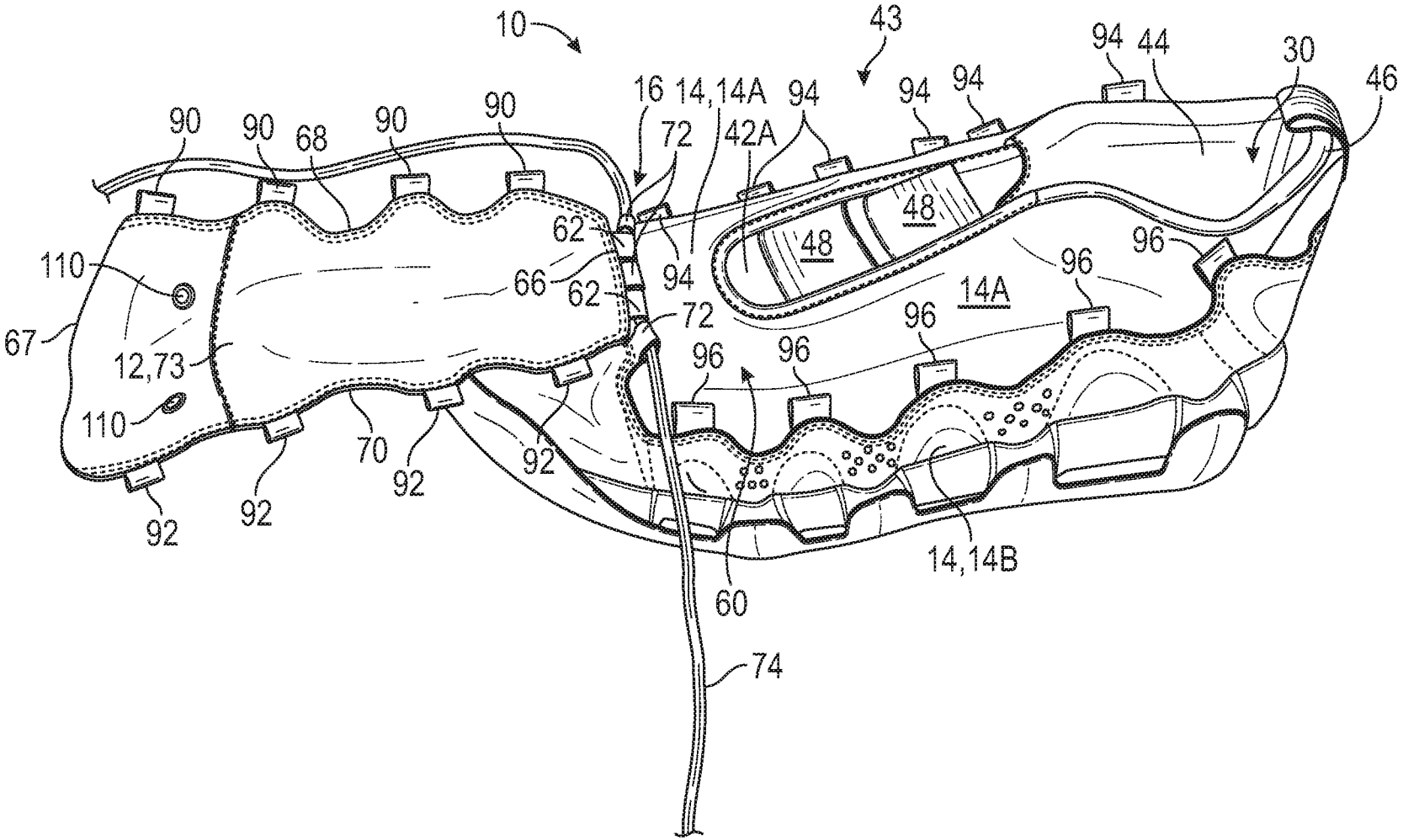
FIG. 3 is a perspective view of the article of footwear of FIG. 1 showing the tongue pivoted about a hinged connection to the upper.

As best shown in FIG. 3, the inner layer 14A includes a throat opening 42A generally in an instep region 43 of the article of footwear 10. The throat opening 42A extends to and includes an ankle opening 44 generally surrounded by a collar 46 of the inner layer 14A. The throat opening 42A and ankle opening 44 together serve as an access opening for entry for a foot into the foot-receiving cavity 30. In the embodiment shown, two stretchable straps 48 span the throat opening 42A. Alternatively, the inner layer 14A could be a sock construction having only an ankle opening. Still further, in some embodiments, the inner layer 14A may be eliminated, in which case an access opening would extend from a medial side edge 52, to a lateral side edge 50 of the upper 14 (layer 14B), and from the forward edge 58 rearward to the ankle opening 44.

Figure 4:
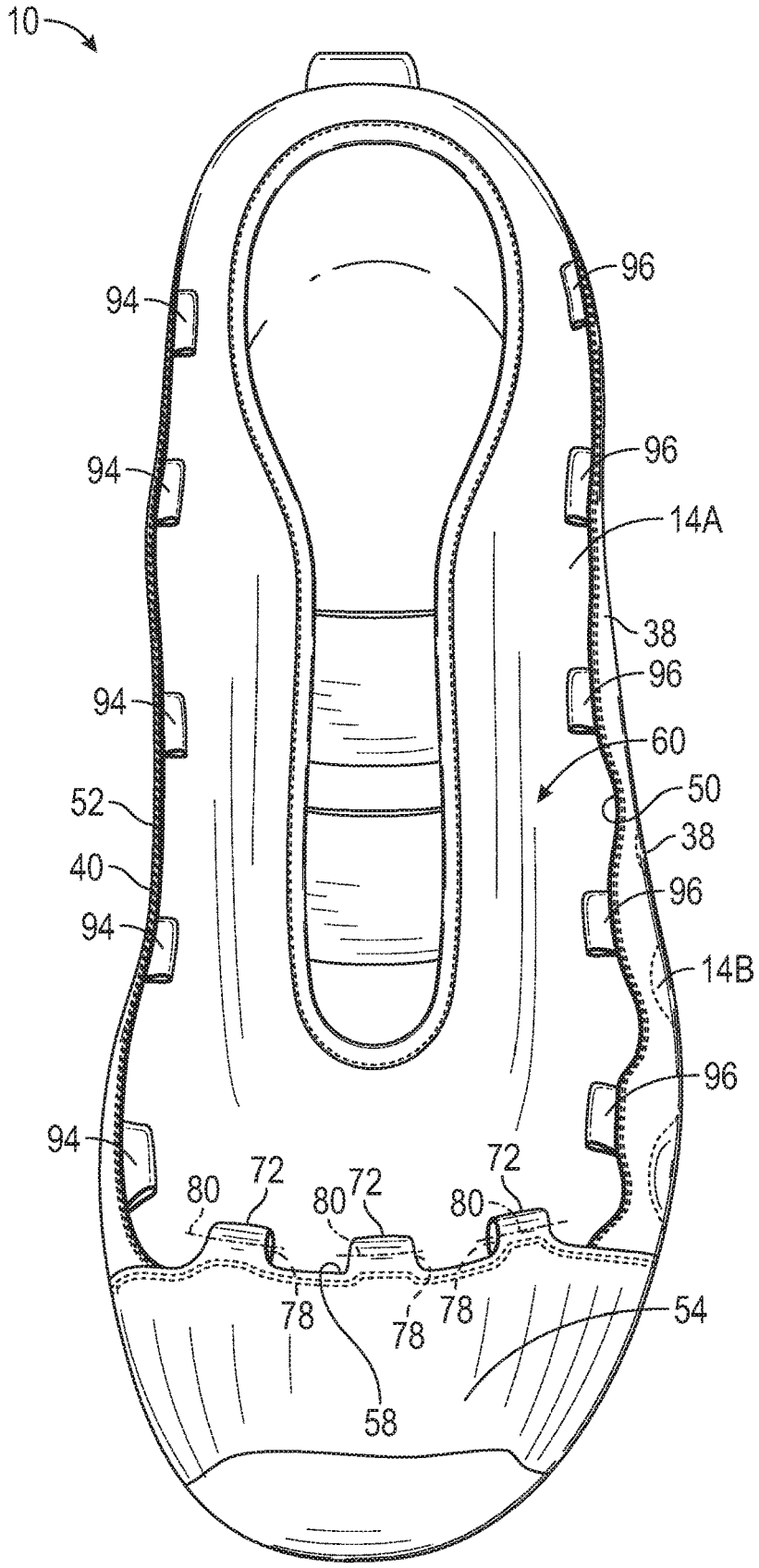
FIG. 4 is a perspective top view of the article of footwear of FIG. 1 with the tongue removed.

With reference to FIG. 4, the lateral side 38 of the outer layer 14B includes a lateral side edge 50, and the medial side 40 of the outer layer 14B includes a medial side edge 52. A front portion 54 of the outer layer 14B is generally located in a toe region 56 of the forefoot portion 32 and includes an edge 58 that is a rearmost extend of the front portion 54, but is a forward edge of an outer layer opening 60 bounded by the lateral side edge 50, the medial side edge 52, and the edge 58. Accordingly, the edge 58 is referred to as a forward edge.

Figure 5:
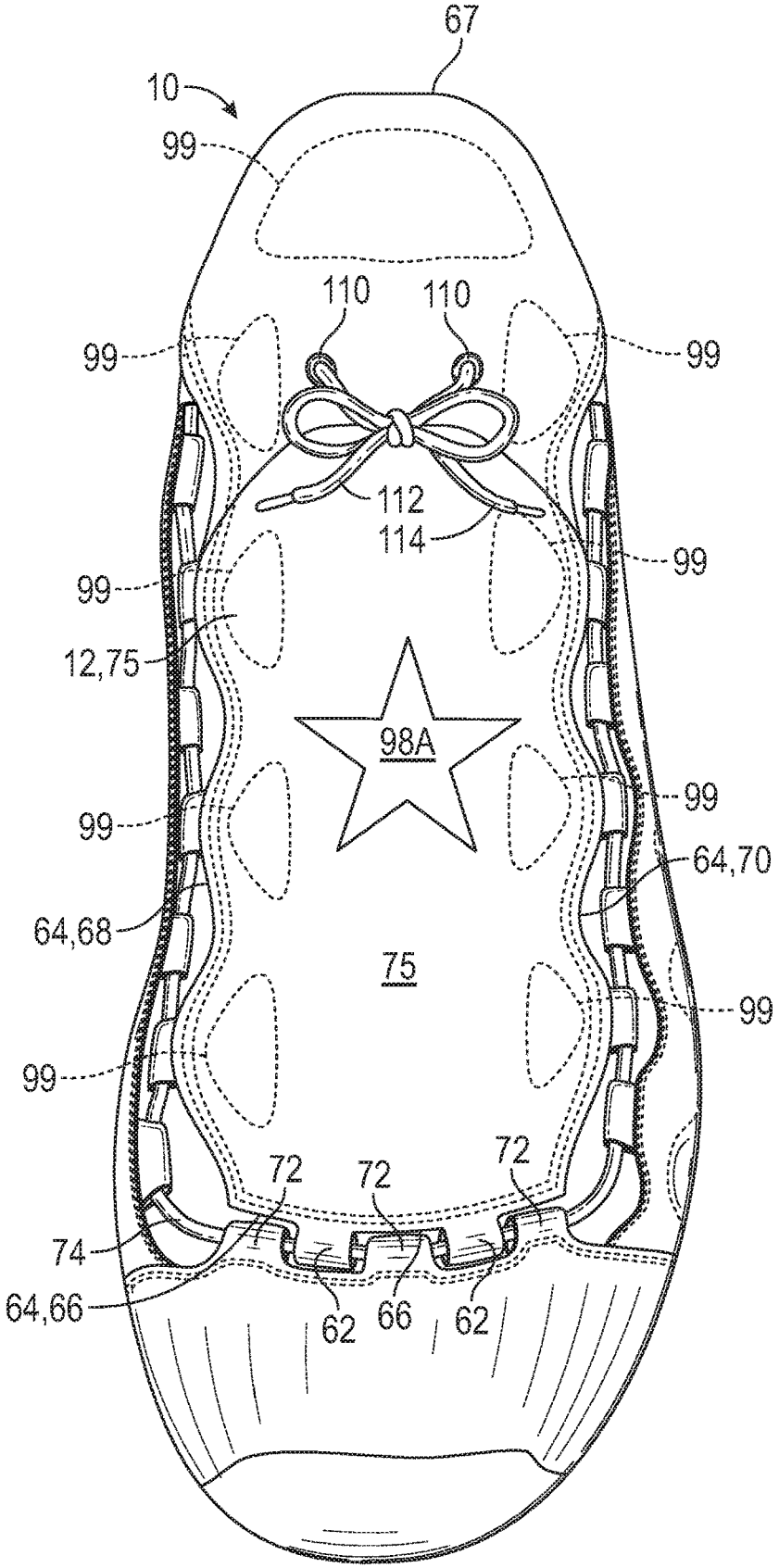
FIG. 5 is a perspective top view of the article of footwear of FIG. 1 with the tongue removably attached and a lace tied.
Figure 6:
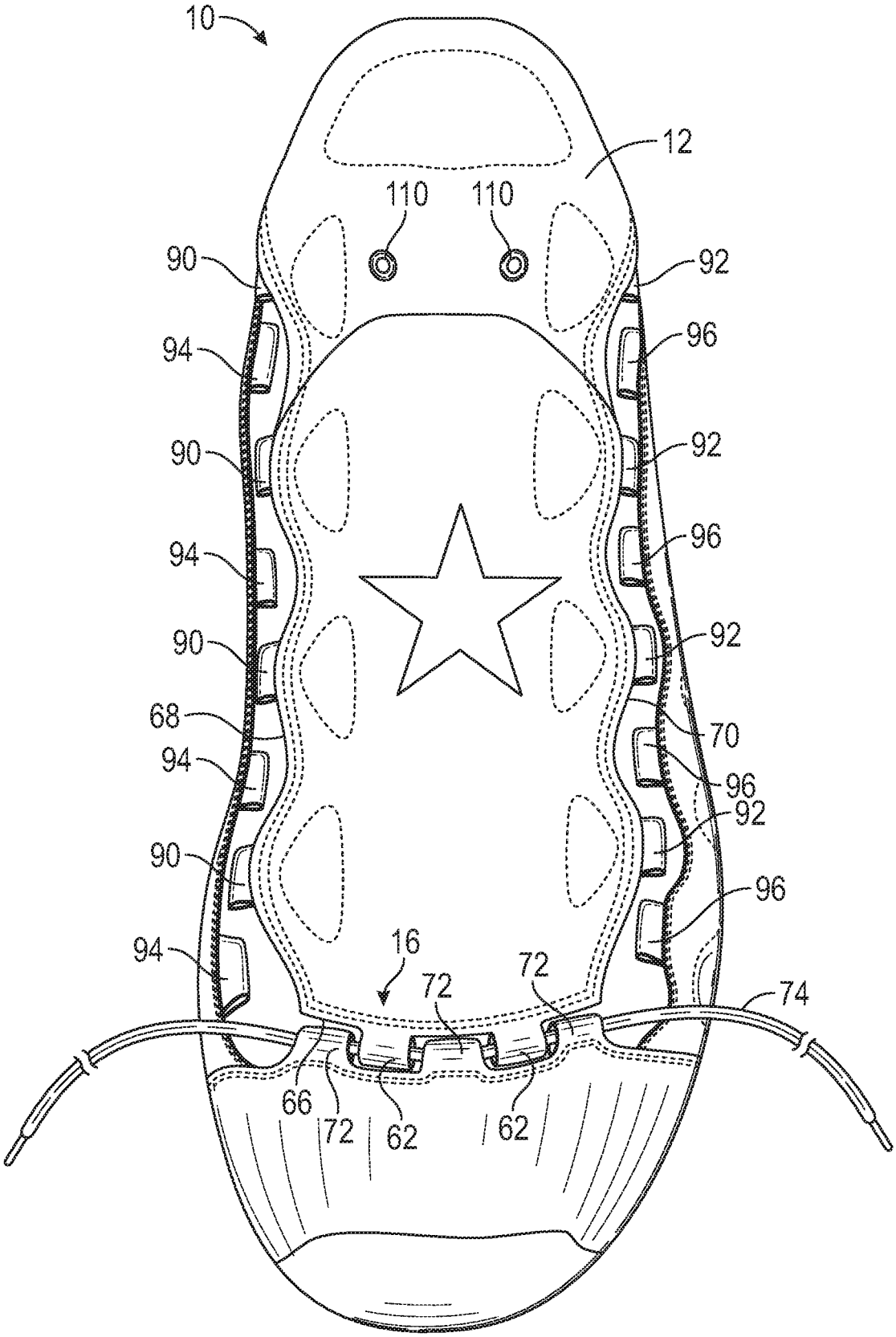
FIG. 6 is a perspective top view of the article of footwear of FIG. 1 with the lace routed through interleaved lace guides of the tongue and the upper.
Figure 9:
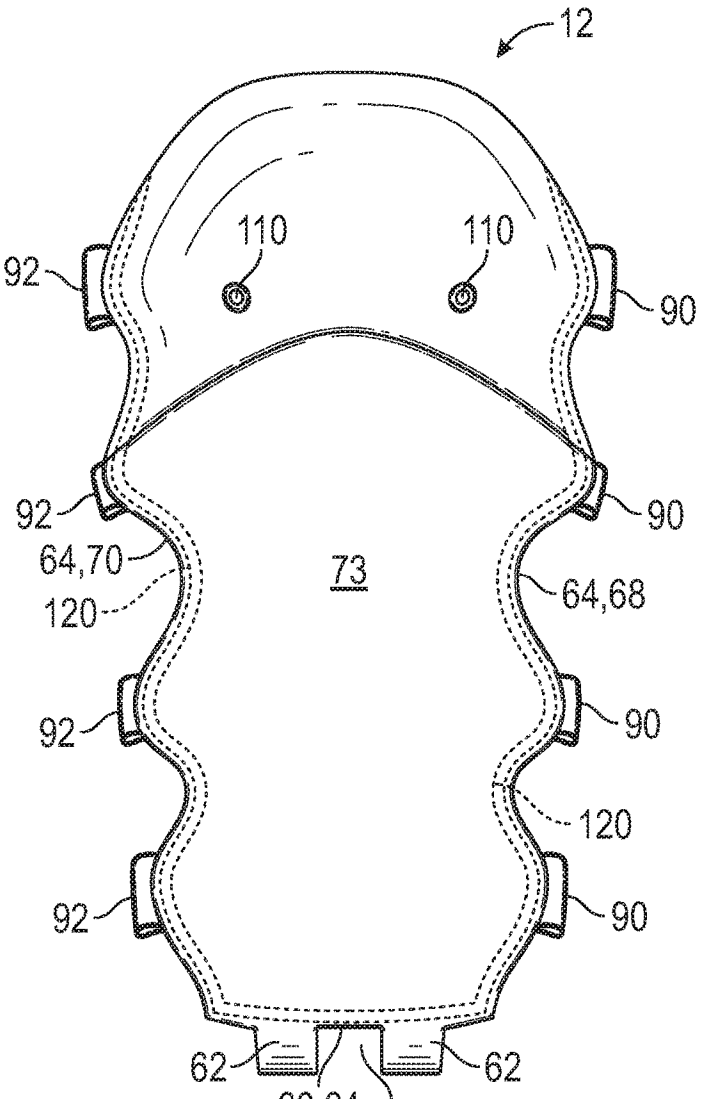
FIG. 9 is a plan view of one side of the tongue of FIG. 1.
Figure 15:
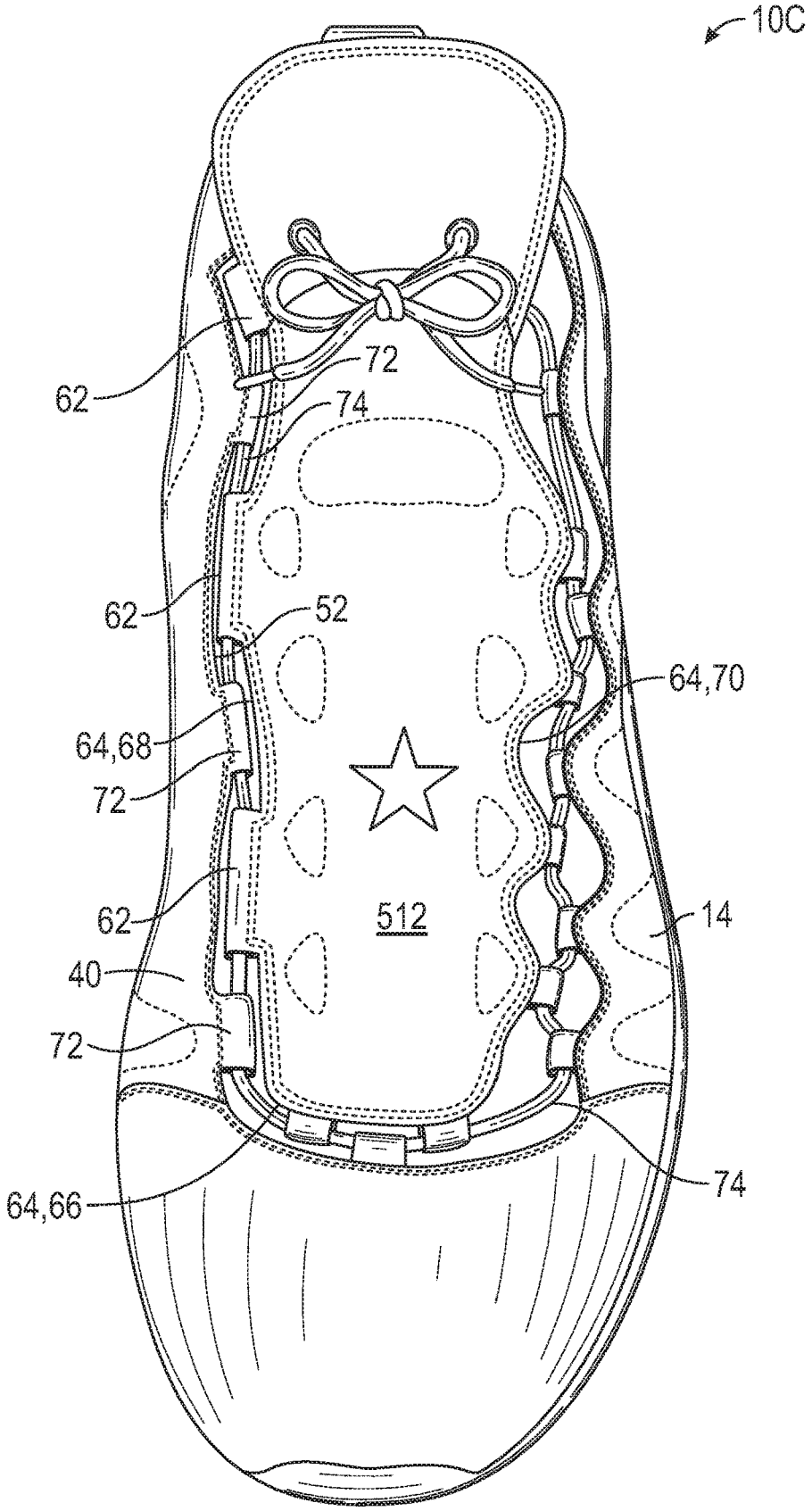
FIG. 15 is a perspective top view of an article of footwear with a removably attachable tongue in an alternative configuration.
Figure 16:
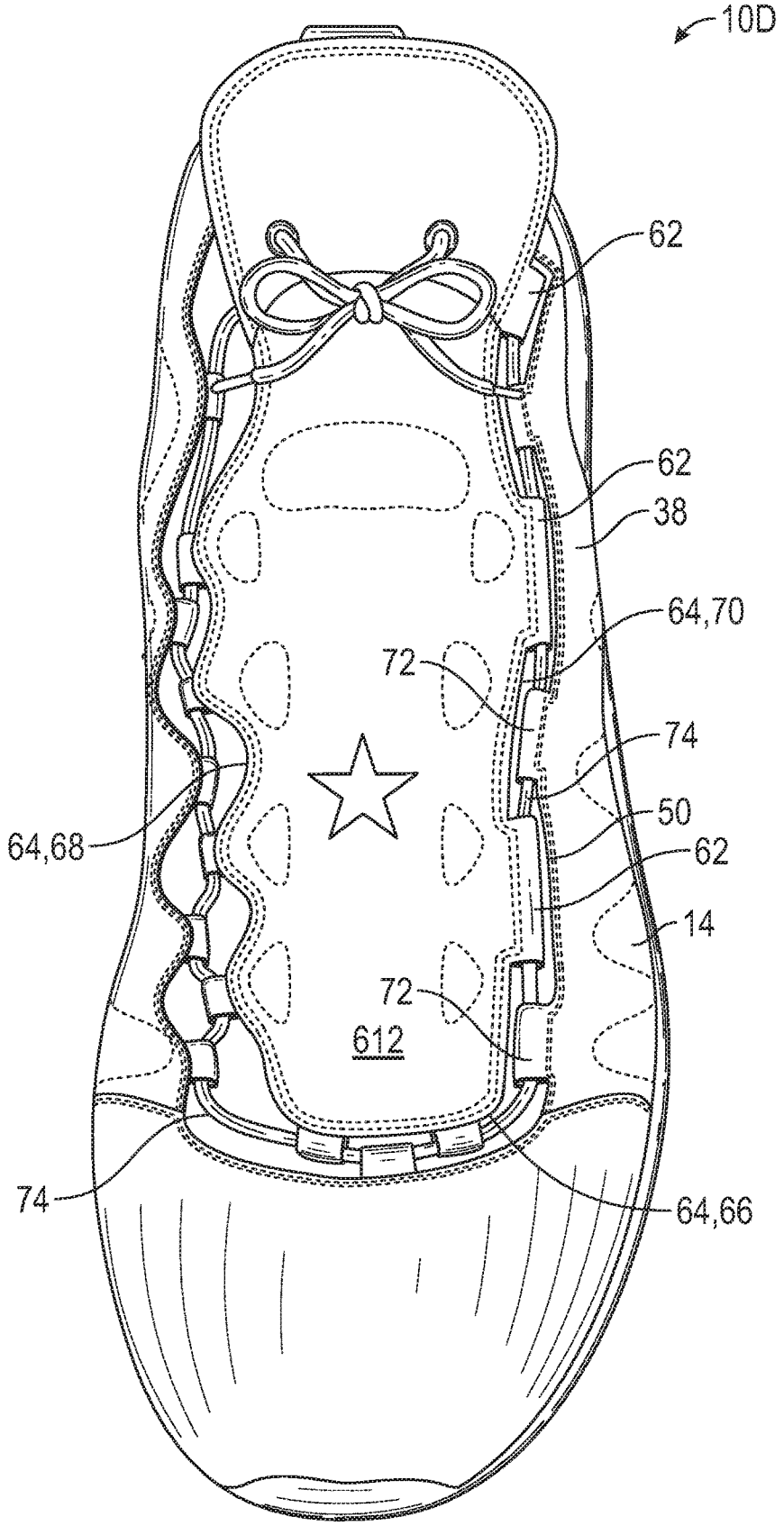
FIG. 16 is a perspective top view of an article of footwear with a removably attachable tongue in an alternative configuration.

As best shown in FIGS. 5 and 6, the tongue 12 includes a first set of lace guides 62. The lace guides 62 extend outward of a perimeter 64 of the tongue at a forward edge 66 of the tongue. As shown in FIG. 9, the lace guides 62 are spaced apart from one another such that a gap 63 exists along the perimeter 64 of the tongue 12 between the two lace guides 62. In other embodiments, such as in the article of footwear 10C with tongue 512 shown in FIG. 15, a first set of lace guides 62 may extend outward of the perimeter 64 of the tongue 512 at a first side edge of the tongue 512 (i.e., at a medial side edge 68 of the tongue, also referred to as a first side edge), or, as shown in the article of footwear 10D with tongue 612 of FIG. 16, a first set of lace guides 62 may extend outward of the perimeter 64 of the tongue 612 at a second side edge of the tongue 612 (i.e., at a lateral side edge 70 of the tongue, also referred to as a second side edge).

Referring again to FIG. 5, the medial side edge 68 of the tongue, the lateral side edge 70 of the tongue, and the forward edge 66 of the tongue are at the perimeter 64 of the tongue with the forward edge 66 being between the medial side edge 68 and the lateral side edge 70. As shown, the lace guides 62 extend from the forward edge 66. In other embodiments, the lace guides 62 may extend from the tongue 12 adjacent the forward edge 66 (but not from the forward edge 66 per se), but in either case extend outward of the forward edge 66.

As best shown in FIGS. 3 and 4, the outer layer 14B of the upper 14 includes a second set of lace guides 72. The lace guides 72 extend rearward from the forward edge 58 of the front portion 54 of the outer layer 14B. More specifically, the lace guides 72 extend into the opening 60 formed by the outer layer 14B (i.e., the space between the medial side 40 and the lateral side 38). In other embodiments, the lace guides 72 may extend from the upper 14 adjacent the forward edge 58 (but not from the forward edge 58 per se), but in either case extend outward of the forward edge 58. In other embodiments, such as in the article of footwear 10C shown in FIG. 15, a second set of lace guides 72 may extend outward of the medial side edge 52 at the medial side 40 of the upper 14, interleaved with a first set of lace guides 62 extending from the medial side edge 68 of the tongue 512. Alternatively, as shown in the article of footwear 10D of FIG. 16, a second set of lace guides 72 may extend outward of the lateral side edge 50 of the lateral side 38 of the upper 14, interleaved with 5 first set of lace guides 62 that extend from the lateral side edge 70 of the tongue 612.

Figure 13:
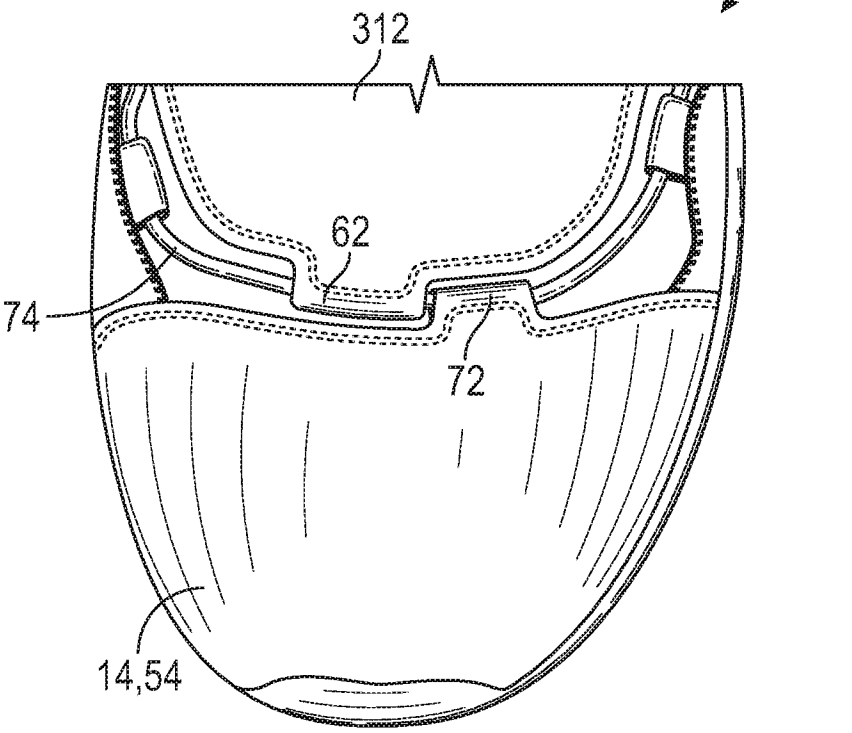
FIG. 13 is a fragmentary perspective top view of an article of footwear with a removably attachable tongue in an alternative configuration.

As shown in FIGS. 1, 2, 5, and 6, the first set of lace guides 62 is interleaved with the second set of lace guides 72 when the tongue 12 is positioned adjacent the upper 14. The gap 63 between lace guides 62 allows one of the lace guides 72 to fit between the adjacent lace guides 62. Each of the lace guides 62 is between a pair of adjacent lace guides 72. In some embodiments, the first set of lace guides may be a set of one, including only a single first lace guide 62, and the second set of lace guides may be a set of one, including only a single second lace guide 72, as shown in the article of footwear 10A including tongue 312 in FIG. 13.

Each lace guide 62, 72 is configured to retain a lace 74 at the lace guide, but to allow the lace to slide along its length with respect to the lace guide. For example, lace guides 62, 72 are each configured as a loop with an opening, and permit a lace 74 to extend through the opening of the lace guide 62, 72 so that the lace 74 can slide through the loop but is restrained from moving laterally out of the lace guide. When a lace 74 is routed through the interleaved lace guides 62, 72, the tongue 12 is removably attached to the upper 14 by the lace 74, such that the tongue 12 is hinged to the upper 14 at the first set of lace guides 62 and the second set of lace guides 72, and is removable from the upper 14 by withdrawing the lace 74 and moving the tongue 12 away from the upper 14. As shown by FIGS. 3 and 6, the interleaved lace guides 62, 72 and the lace 74 routed therethrough form a hinged connection 16, also referred to as a hinge 16, so that the tongue 12 is hinged to the upper 14 and is pivotable relative to the upper 14 about the lace 74 running through the interleaved lace guides 62, 72. FIG. 3 illustrates the tongue 12 pivoted to fully expose the opening 60 between the lateral and medial sides 38, 40 of the outer layer 14B. In embodiments in which there is no inner layer 14A, the pivoted tongue 12 fully exposes the foot-receiving cavity 30 to enable easy foot entry. Stated differently, a foot can be inserted downward into an opening exposed between the lateral and medial sides 38, 40, and the opening is much larger than if a standard tongue overlaid with a crisscrossing lace were used.

The tongue 12 may be referred to as a footwear component. The removability of the tongue 12 from the upper 14 without damage or deformation to either enables the possibility of additional or replacement tongues to be obtained for alternate removable attachment to the upper 14 as discussed herein.

Figure 8:
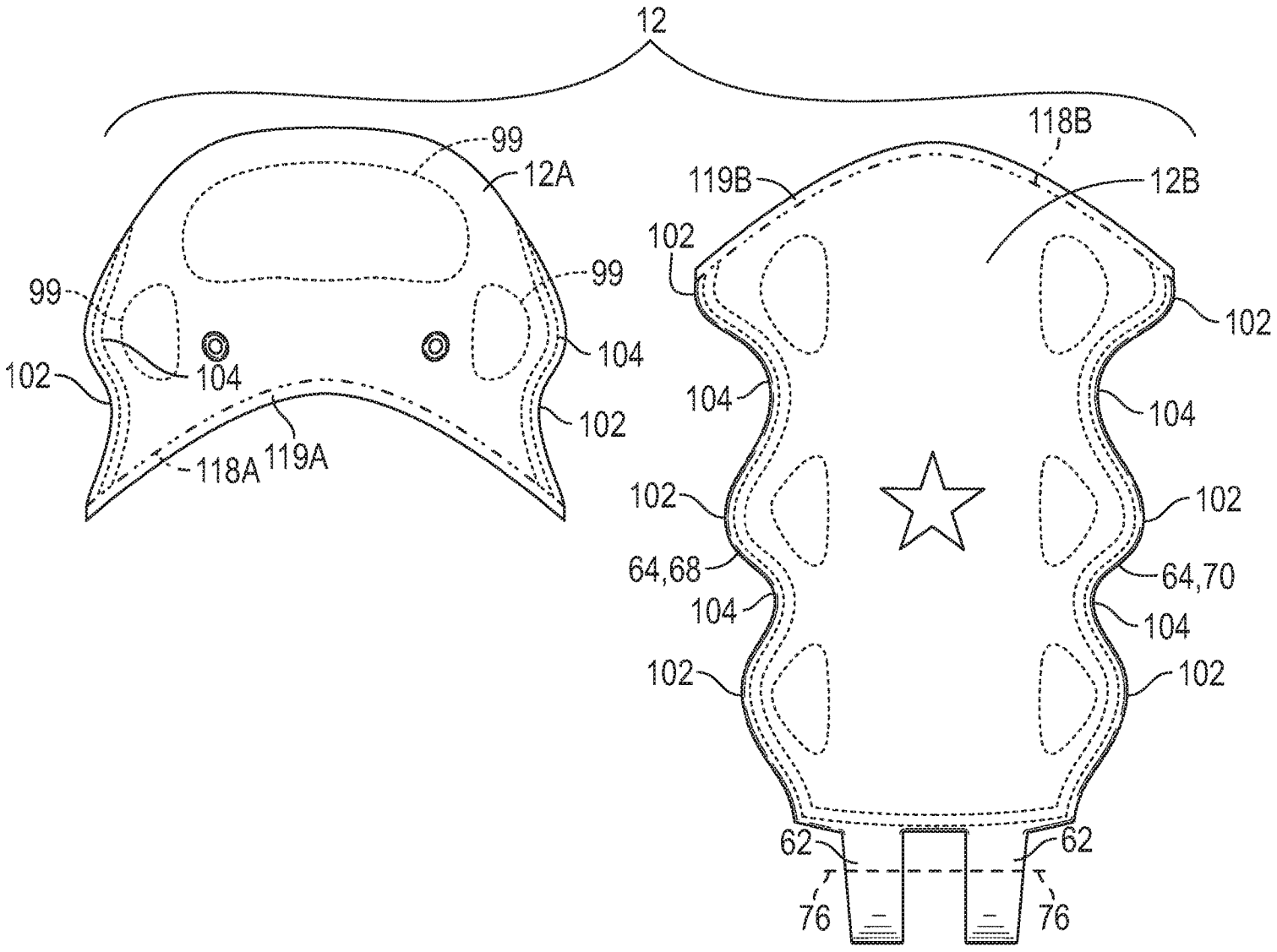
FIG. 8 is an exploded view of the tongue of FIG. 1.
Figure 11:
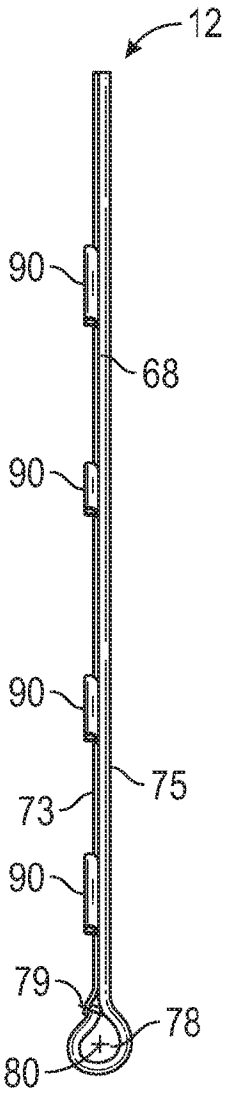
FIG. 11 is a side view of the tongue of FIGS. 9 and 10.

Referring to FIG. 8, the lace guides 62 are integral portions of and a unitary, one-piece component of the tongue 12. Stated differently, the lace guides 62 are extensions of the same material of the tongue 12 at the perimeter. The lace guides 62 are generally folded at fold lines 76 and, as shown in FIG. 11, ends of the lace guides 62 are then stitched to the tongue 12 such as between a first side 75 of the tongue 12 (also referred to as a first layer, an outer layer, or an outer side of the tongue) and a second side 73 of the tongue 12 (also referred to as a second layer, an inner layer, or an inner side of the tongue) at stitching 79, so that the lace guides 62 are tubular loops. As shown in FIG. 11, the lace guide 62 has a central opening 78 with a center axis 80 extending parallel to the forward edge 66 of the tongue 12.

Similarly, the lace guides 72 are integral portions of and a unitary, one-piece component of the upper 14 in that they are extensions of the same material of the upper 14 at the front portion 54, and are folded over and stitched to the upper 14 to form tubular loops. The lace guides 72 also have a central opening 78 with a center axis 80 extending parallel to the forward edge 66 of the tongue 12 as shown in FIG. 5.

Although the lace guides 62 are integral portions of the tongue 12 and the lace guides 72 are integral portions of the upper 14, one or more of the lace guides 62 and/or one or more of the lace guides 72 may instead be discrete loops secured to the tongue 12 or the upper 14, respectively. For example, the lace guides 62, 72 may be a flexible webbing material, or other material different from that of the tongue 12 and/or of the upper 14.

Figure 14:
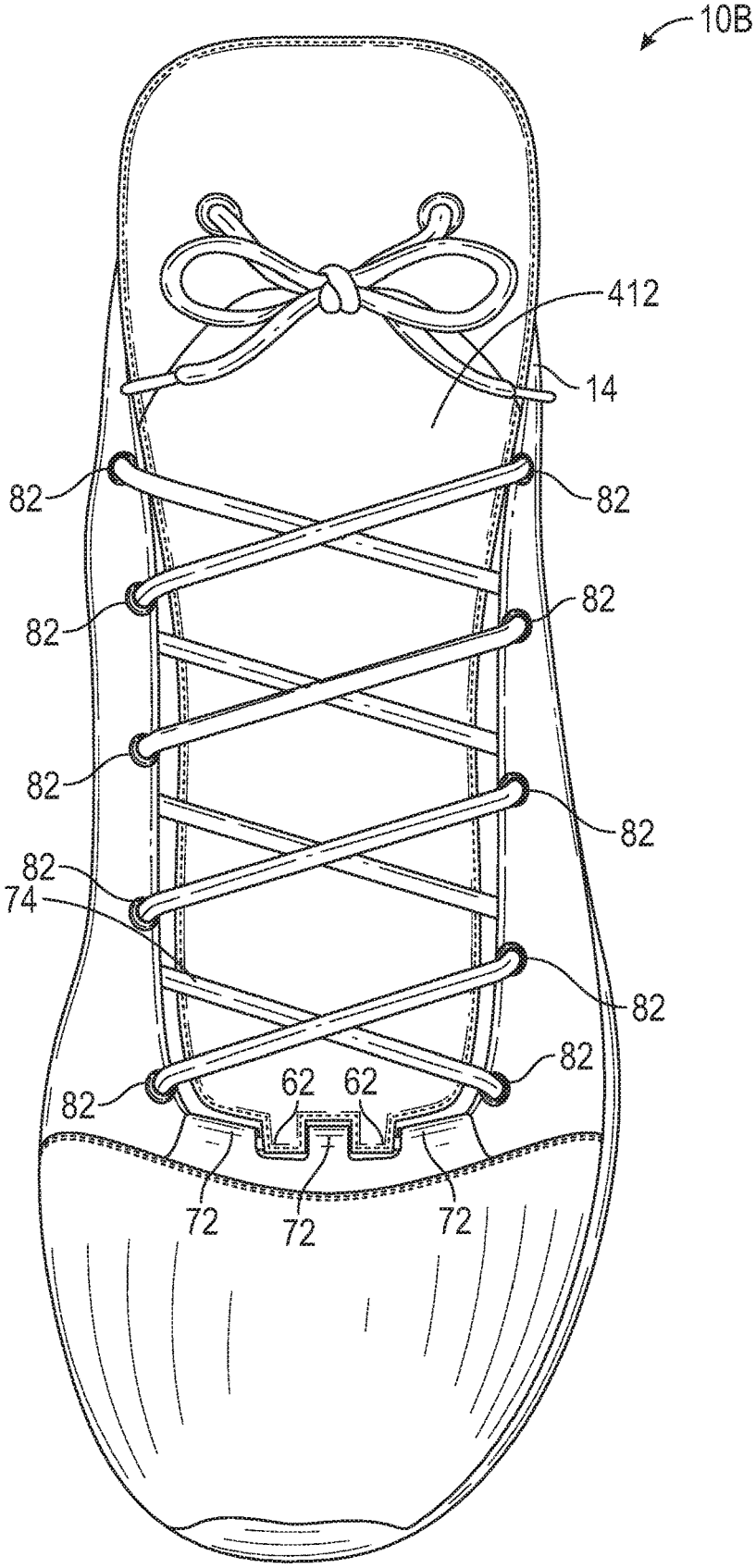
FIG. 14 is a perspective top view of an article of footwear with a removably attachable tongue in an alternative configuration.

In some embodiments, the only interleaved lace guides extending from the tongue 12 or from the upper 14 are the first and second sets of lace guides 62, 72. For example, in the article of footwear 10B including tongue 412 of FIG. 14, eyelets 82 extend through the medial and lateral sides of the upper 14, and the lace 74 is routed through the eyelets 82 in any order after the tongue 412 is removably attached to the upper 14 by routing the lace 74 through the interleaved lace guides 62, 72.

In other embodiments, the tongue 12 and the upper 14 have additional interleaved lace guides. For example, as best shown in FIGS. 2, 3, 6, and 10, a first set of medial lace guides 90 extends outward of the medial side edge 68 of the tongue 12, and a first set of lateral lace guides 92 extends outward of the lateral side edge 70 of the tongue 12. Moreover, a second set of medial lace guides 94 extends from the medial side 40 of the upper 14, and a second set of lateral lace guides 96 extends from the lateral side 38 of the upper 14. When the tongue 12 is disposed at the upper 14 with the first and second sets of lace guides 62, 72 interleaved, the first set of medial lace guides 90 is also interleaved with the second set of medial lace guides 94, and the first set of lateral lace guides 92 is also interleaved with the second set of lateral lace guides 96.

Figure 7:
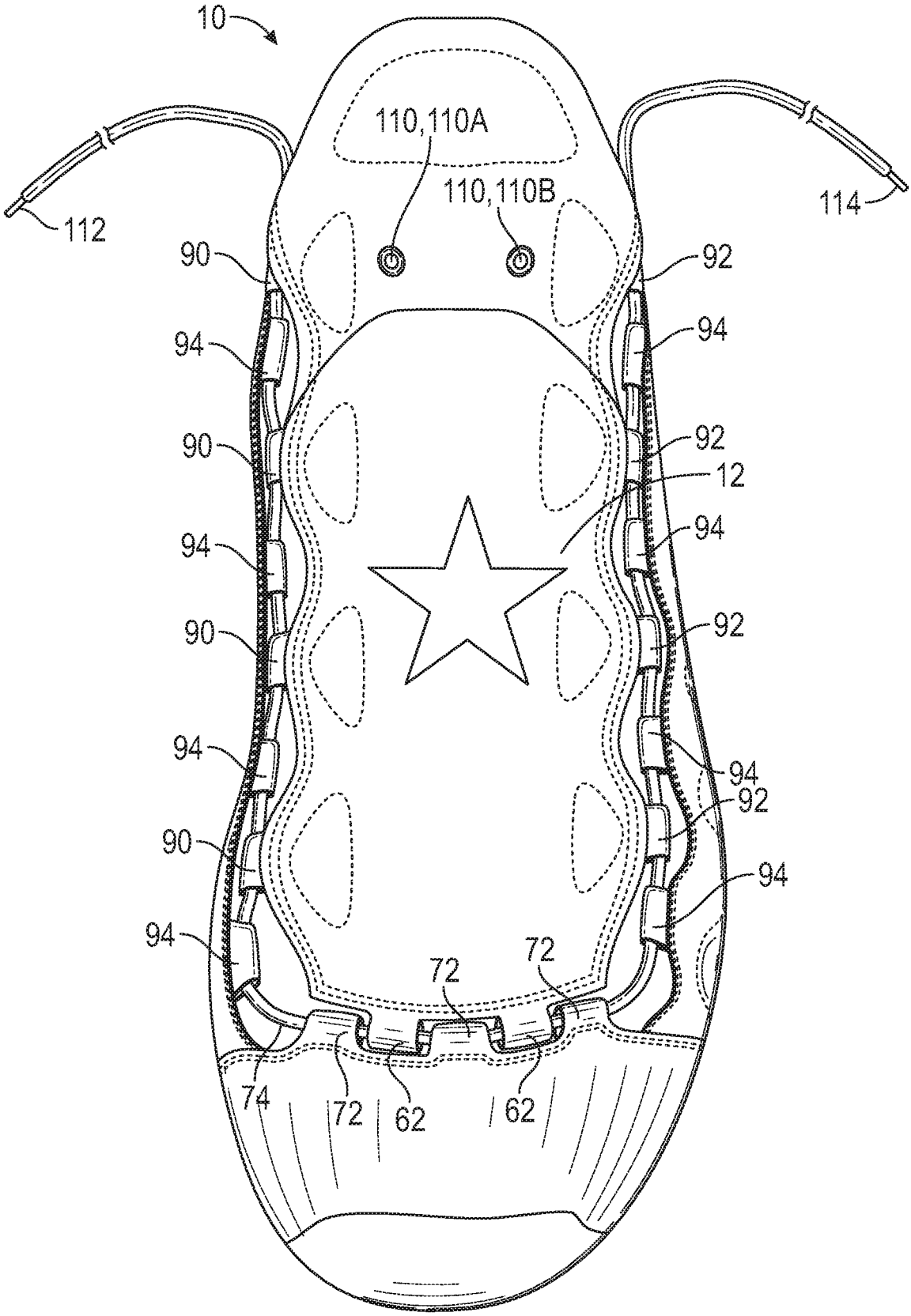
FIG. 7 is a perspective top view of the article of footwear of FIG. 6 with the lace further routed through medial and lateral lace guides.

The tongue 12 can be further removably attached to the upper 14 by the lace 74 when the lace 74 is routed through the first and second sets of medial lace guides 90, 94, and through the first and second sets of lateral lace guides 92, 96, as shown in FIG. 7. It should be appreciated that, although the lace 74 is described as being routed through the lace guides 62, 72 prior to the lace guides 90, 92, 94, 96, the lace 74 may alternatively be routed through the interleaved medial lace guides 90, 94, or through the interleaved lateral lace guides 92, 96, prior to routing through lace guides 62, 72.

In the embodiment of FIGS. 1-11, the first and second sets of medial lace guides 90, 94, and the first and second sets of lateral lace guides 92, 96 are discrete lace guides secured to the tongue 12 (lace guides 90, 92) and the upper 14 (lace guides 94, 96), respectively, by stitching, adhesive, or otherwise. Discrete lace guides are lace guides that are not constructed initially as a unitary, one piece component with the tongue 12 or the upper 14 to which they are connected. Instead, they are made integral with the tongue 12 or upper 14, such as by stitching, adhesive, or otherwise. Discrete lace guides 90, 92, 94, 96 may be a different material than the tongue 12 or the upper 14, such as a flexible nylon webbing. Alternatively, any or all of the discrete lace guides 90, 92, 94, 96 may be the same material as the tongue 12 and/or the upper 14. Accordingly, the first set of medial lace guides 90 and the first set of lateral lace guides 92 are discrete loops secured to the tongue 12. The second set of medial lace guides 94 and the second set of lateral lace guides 96 are discrete loops secured to the upper 14.

When the article of footwear 10 is provided with the medial lace guides 90, 94 and the lateral lace guides 92, 96, the lace 74 can be routed so that it secures the tongue 12 to the upper 14 without crossing from the first set of medial lace guides 90 and the second set of medial lace guides 94 to the first set of lateral lace guides 92 and the second set of lateral lace guides 96. Stated differently, the lace 74 can route along the medial side edge 68 of the tongue 12 through the interleaved medial lace guides 90, 94, and also along the lateral side edge 70 of the tongue 12 through the lateral lace guides 92, 96 without crossing laterally over the tongue 12 from the medial lace guides 90, 94 to the lateral lace guides 92, 96. More of the surface of the exposed outer side of the tongue 12 will be exposed than if the lace 74 crossed laterally over the tongue 12. Any image, color, texture, or material on the exposed outer side of the tongue 12 will not be obscured by the lace 74. For example, as shown in FIG. 5, an image 98A on the first side 75 of the tongue 12 is fully exposed and is spaced apart from any portion of the lace 74. Any pattern 99 of stitching is also exposed.

Figure 10:
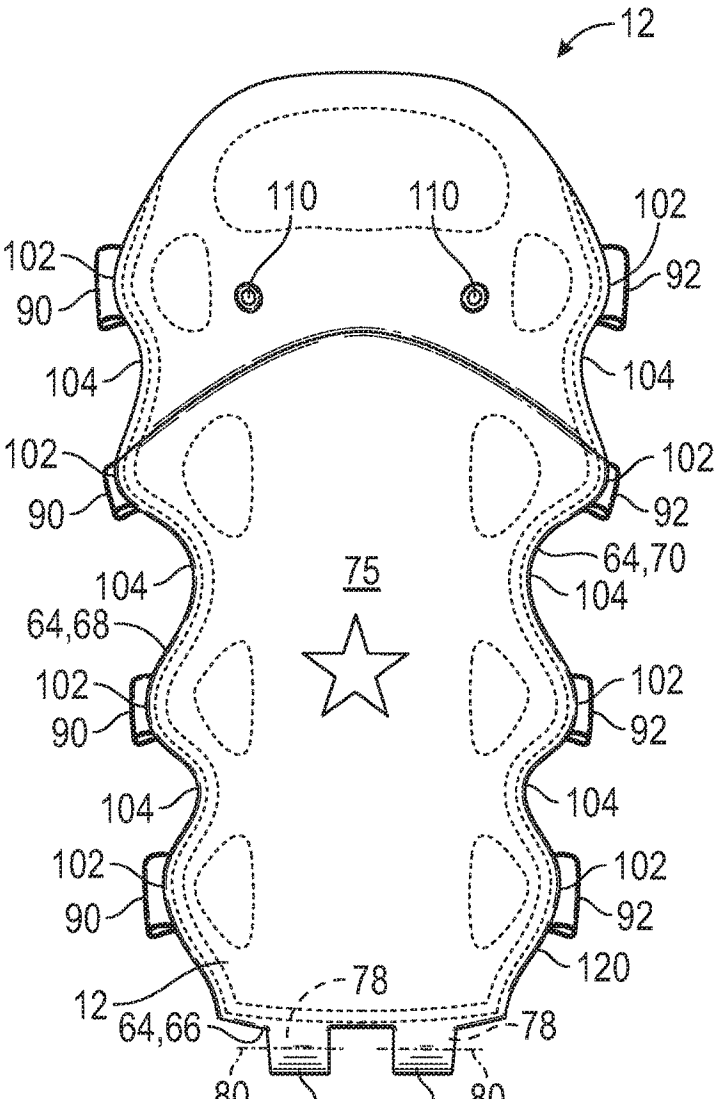
FIG. 10 is a plan view of an opposite side of the tongue of FIG. 9.

The tongue 12 and the upper 14 may be configured to aid in the ability of the lace guides to interleave with one another. For example, as shown in FIG. 10, the tongue 12 has alternating peaks 102 and valleys 104 at the medial side edge 68 of the tongue, and alternating peaks 102 and valleys 104 at the lateral side edge 70 of the tongue. The first set of medial lace guides 90 extends from the peaks 102 of the medial side edge 68 of the tongue. The first set of lateral lace guides 92 extends from the peaks 102 of the lateral side edge 70 of the tongue. As shown in FIG. 2, the outer layer 14B of the upper 14 also has alternating peaks 106 and valleys 108 at the medial side 40 of the upper 14. The outer layer 14B also has alternating peaks 106 and valleys 108 at the lateral side 38 of the upper 14, as shown in FIG. 1.

The second set of medial lace guides 94 extends from the peaks 106 of the medial side 40 of the upper 14. The second set of lateral lace guides 96 extends from the peaks 106 of the lateral side 38 of the upper. The tongue 12 and the upper 14 are sized and shaped so that the second set of medial lace guides 94 align with the valleys 104 at the medial side edge 68 of the tongue 12, and the first set of medial lace guides 90 align with the valleys 108 at the medial side 40 of the upper 14. Similarly, the second set of lateral lace guides 96 align with the valleys 104 at the lateral side edge 70 of the tongue 12, and the first set of lateral lace guides 92 align with the valleys 108 at the lateral side 38 of the upper 14. As the lace 74 is pulled tighter, the peaks 106 of the tongue 12 move closer to the valleys 108 of the upper 14, the peaks 102 of the upper 14 move closer to the valleys 104 of the tongue 12, and the lace 74 therefore extends more linearly between the sets of medial lace guides 90, 94, and between the sets of lateral lace guides 92, 96.

Referring to FIGS. 3 and 5-7, the tongue 12 has a pair of lace openings 110 extending through the tongue 12 from the inner side 73 of the tongue 12 (see FIG. 3) to the outer side 75 of the tongue 12 (see FIG. 5). The pair of openings 110 is closer to a rearward edge 67 of the tongue 12 than to the forward edge 66 of the tongue 12. A first end 112 of the lace 74 is shown in FIG. 7 and can be routed from the inner side 73 to the outer side 75 so that it extends through a first opening 110A of the pair as in FIG. 5. Similarly, a second end 114 of the lace 74 can be routed from the inner side 73 to the outer side 75 so that it extends through a second opening 110B of the pair. As shown in FIG. 5, the ends 112, 114 can be tied together in a bow at the outer side 75 of the tongue.

As best shown in FIG. 8, the tongue 12 can be constructed from an upper portion 12A and a lower portion 12B. The upper portion 12A and the lower portion 12B are shown in FIG. 8 prior to attachment of the first sets of medial and lateral lace guides 90, 92 (shown in FIG. 10) at the peaks 102. A lower extremity of the upper portion 12A is folded under at the fold line 118A, and the fold line 118A is positioned along line 118B of the lower portion 12B, and the portions 12A, 12B are stitched, adhered, or otherwise secured together along the overlaying flanges 119A, 119B at lines 118A, 118B. The juncture of the upper portion 12A and the lower portion 12B along the lines 118A, 118B generally provides flexibility at the front of the ankle of a wearer. In other embodiments, the entire tongue 12 may be a unitary, one-piece component, rather than an upper portion and a lower portion made integral. A pattern 99 may also be stitched through the upper portion 12A and the lower portion 12B. The pattern 99 is stitched only through the first layer 75, prior to the second layer 73 being stitched to the first layer 75 along the perimeter 64 with stitching 120, evident at both the second side 73 in FIG. 9 and the first side 75 in FIG. 10.

Because the tongue 12 is removably attachable to the upper 14, it may be worn with either the first side 75 outward and exposed, or the second side 73 outward and exposed. Stated differently, the tongue 12 is reversible such that the first side 75 of the tongue 12 is exposed when the tongue 12 is removably attached to the upper 14 in a first orientation shown in FIG. 5, but may also be worn with the second side 73 (i.e., the side opposite from the first side) exposed when the tongue 12 is removably attached to the upper in a second orientation. To establish the second orientation, the tongue 12 need only be flipped from its orientation in FIG. 5 to an orientation in FIG. 9 prior to routing the lace 74 through the lace guides 62, 72. Because the forward edge 66 of the tongue 12 is symmetrical, and the tongue 12 is sufficiently flexible and flat, it can be secured in the second orientation with the second side 73 facing outward. Although the second side 73 is shown without an image, it may have a color, texture, material or an image different than that of the first side 75.

In addition to or instead of the tongue 12 being reversible, the article of footwear 10 can be included in a footwear system that includes at least two alternately removable attachable tongues. Accordingly, a footwear system 14, 18, 12, 212 includes both the sole structure 18 and the upper 14, the first tongue 12, as well one or more additional tongues such as a second tongue 212 shown in FIG. 12. Stated differently, the footwear system includes an article of footwear, such as article of footwear 10, 10A, 10B, 10C, or 10D, with two alternately usable tongues. Each of the tongues 12, 212 has a perimeter 64 with a first set of lace guides 62 extending outward of the perimeter. The first tongue and the second tongue alternately fit adjacent the upper 14 with the first set of lace guides 62 interleaved with the second set of lace guides 72. Each of the first tongue 12 and the second tongue 212 is alternately removably attachable to the upper 14 by the lace 74 routed through the first set of lace guides 62 and the second set of lace guides 72, and is removable from the upper 14 by withdrawing the lace 74 from the first set of lace guides 62 and the second set of lace guides 72.

Although both tongues 12, 212 show lace guides 62 extending from the forward edge 66, within the scope of the disclosure, footwear systems may include first and second tongues in which the lace guides 62 may extend from different portions of the perimeter on the second tongue than on the first tongue. For example, the lace guides 62 may extend from any of the forward edge 66, medial side edge 68 or lateral side edge 70 on one of the tongues 12, 212, and a different one of the forward edge 66, medial side edge 68 or lateral side edge 70 on the other one of the tongues, assuming that the upper 14 has corresponding lace guides on those ones of the edges 50, 52 and 58 that correspond with those of the tongues 12, 212.

The first tongue and the second tongue included in a footwear system within the scope of the disclosure have at least one different characteristic. For example, the first tongue and the second tongue may have at least one of an image, color, texture, or material different than that of the first tongue. Still further, the first tongue and the second tongue may have a different number or placement of lace guides, or the lace guides may be of a different material or size, or may be an integral portion of one of the tongues (i.e., the lace guides and the body of the tongue are a unitary one-piece component), but discrete lace guides secured to the other one of the tongues. Other non-limiting examples of a characteristic of the first and second tongues that may be different include a different size (as long as both still fit to the upper 14 sufficiently to be removably attachable thereto), a different stiffness, or there may be different additional components incorporated in the tongue such as plates, air bladders, etc.

For example, in the embodiments shown, the tongue 212 has a different image 98B on its outer side 75 than does the tongue 12. More specifically, image 98B on the tongue 212 includes text "ABC", while the image 98A on the tongue 12 includes a star shape. In other examples, either or both could include an image that is a photograph, a team name, team colors, a number, or the wearer's name or initials. In some embodiments, the image may be a personalized image provided by a customer to a commercial provider of the tongues, or an image selected by the customer from a group of images available from the provider. Stated differently, the tongue may be customized.

Figure 12:
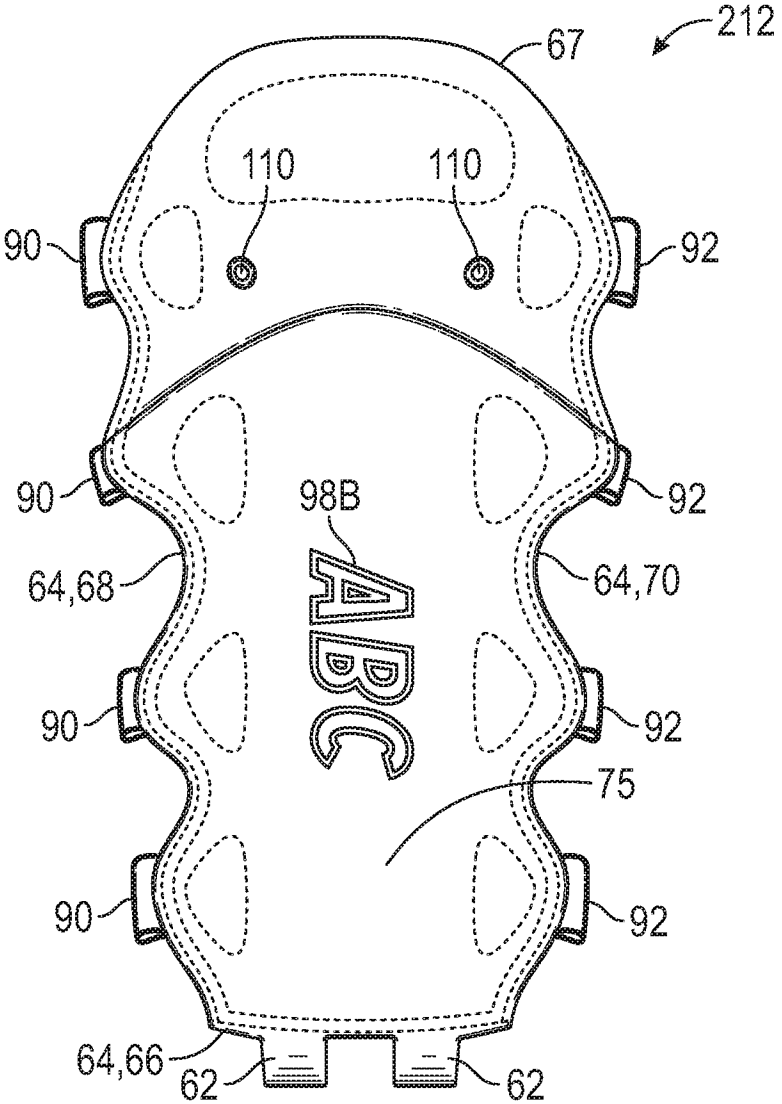
FIG. 12 is a plan view of an alternate tongue for use with the article of footwear of FIG. 1.

With further reference to FIG. 12, like the first tongue 12, the second tongue 212 has a medial side edge 68, a lateral side edge 70, and a forward edge 66. The first set of lace guides 62 extends outward of the forward edge 66 of the tongue 212. A first set of medial lace guides 90 extends outward of the medial side edge 68 of the tongue 212 and is interleaved with the second set of medial lace guides 94 extending from the medial side 40 of the upper 14 when the tongue 212 is placed adjacent the upper 14 with the lace guides 62, 72 interleaved. A first set of lateral lace guides 92 extends outward of the lateral side edge 70 of the tongue 212 and is interleaved with the second set of lateral lace guides 96 extending from the lateral side 38 of the upper 14 when the tongue 212 is placed adjacent the upper 14 with the lace guides 62, 72 interleaved. The tongue 212 is further removably attachable to the upper 14 by the lace 74 being routed through the first and second sets of medial lace guides 90, 94, and through the first and second sets of lateral lace guides 92, 96.

Accordingly, the hinged connection of the tongue 12 to the upper 14 via the interleaved lace guides 62, 72 enables removable attachability of different tongues 12, 212, allowing customization and alternate use of different tongues with the same upper 14.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

an upper;

a tongue having a first set of lace guides extending outward from a perimeter of the tongue;

wherein the upper has a second set of lace guides;

wherein the first set of lace guides is interleaved with the second set of lace guides when the tongue is positioned adjacent the upper, the tongue being removably attached to the upper by a lace routed through the first set of lace guides and the second set of lace guides such that the tongue is hinged to the upper at the first set of lace guides and the second set of lace guides;

wherein the tongue has a perimeter with a first side edge, a second side edge, and a front edge;

wherein the upper has a medial side, a lateral side, and a front portion; and wherein the first set of lace guides extends outward of the front edge of the tongue, and the second set of lace guides extends outward of the front portion of the upper.

2. The article of footwear of claim 1, wherein the first set of lace guides and the second set of lace guides are tubular loops each having a central opening extending parallel to the front edge of the tongue.

3. The article of footwear of claim 1, further comprising:

a first set of medial lace guides extending outward of the first side edge of the tongue;

a first set of lateral lace guides extending outward of the second side edge of the tongue;

a second set of medial lace guides extending from the medial side of the upper and interleaved with the first set of medial lace guides;

a second set of lateral lace guides extending from the lateral side of the upper and interleaved with the first set of lateral lace guides; and wherein the tongue is further removably attached to the upper by the lace being routed through the first and second sets of medial lace guides, and through the first and second sets of lateral lace guides.

4. The article of footwear of claim 3, wherein the lace secures the tongue to the upper without crossing from the first set of medial lace guides and the second set of medial lace guides to the first set of lateral lace guides and the second set of lateral lace guides.

5. The article of footwear of claim 3, wherein:

the tongue has alternating peaks and valleys at the first side edge of the tongue, and alternating peaks and valleys at the second side edge of the tongue;

the first set of medial lace guides extends from the peaks of the first side edge of the tongue;

the first set of lateral lace guides extends from the peaks of the second side edge of the tongue;

the upper has alternating peaks and valleys at the medial side of the upper, and alternating peaks and valleys at the lateral side of the upper;

the second set of medial lace guides extends from the peaks of the medial side of the upper; and the second set of lateral lace guides extends from the peaks of the lateral side of the upper.

6. The article of footwear of claim 5, wherein:

the second set of medial lace guides extends into the valleys at the first side edge of the tongue;

the first set of medial lace guides extends into the valleys at the medial side of the upper;

the second set of lateral lace guides extends into the valleys at the second side edge of the tongue; and the first set of lateral lace guides extends into the valleys at the lateral side of the upper.

7. The article of footwear of claim 3, wherein:

the lace guides of the first set are integral portions of the tongue;

the lace guides of the second set are integral portions of the upper; and the first set of medial lace guides and the first set of lateral lace guides are discrete loops secured to the tongue.

8. The article of footwear of claim 1, wherein:

the tongue has a pair of lace openings extending through the tongue from an inner side of the tongue to an outer side of the tongue; and a first end of the lace extends through a first opening of the pair and a second end of the lace extends through a second opening of the pair.

9. The article of footwear of claim 1, wherein the tongue is a first tongue, and further comprising:

a second tongue that has at least one characteristic different than that of the first tongue; and wherein the second tongue is removably attachable to the upper alternatively to the first tongue.

10. The article of footwear of claim 1, wherein:

the tongue is reversible such that a first side of the tongue is exposed when the tongue is removably attached to the upper in a first orientation; and a second side of the tongue opposite from the first side of the tongue is exposed when the tongue is removably attached to the upper in a second orientation.

11. A footwear system comprising:

a first tongue and a second tongue, each having a perimeter with a first set of lace guides extending outward of the perimeter; wherein the first tongue and the second tongue have at least one different characteristic;

an upper having a second set of lace guides;

wherein the first tongue and the second tongue alternately fit adjacent the upper with the first set of lace guides interleaved with the second set of lace guides;

wherein each of the first tongue and the second tongue is alternately removably attachable to the upper by a lace routed through the first set of lace guides and the second set of lace guides, and is removable from the upper by withdrawing the lace from the first set of lace guides and the second set of lace guides;

wherein the perimeter of each of the first tongue and the second tongue has a first side edge, a second side edge, and a front edge;

wherein the first set of lace guides extends outward of the front edge;

wherein the upper has a medial side, a lateral side, and a front portion; and wherein the second set of lace guides extends from the front portion of the upper.

12. The footwear system of claim 11, wherein:

each of the first tongue and the second tongue further comprises:

a first set of medial lace guides extending outward of the first side edge;

a first set of lateral lace guides extending outward of the second side edge;

the upper further comprises:

a second set of medial lace guides extending from the medial side of the upper and interleaved with the first set of medial lace guides; and a second set of lateral lace guides extending from the lateral side of the upper and interleaved with the first set of lateral lace guides; and each of the first tongue and the second tongue is further removably attachable to the upper by the lace being routed through the first and second sets of medial lace guides, and through the first and second sets of lateral lace guides.

13. An article of footwear comprising:

an upper defining an opening in an instep region of the upper;

a tongue configured to fit within the opening of the upper with side edges of the tongue within the opening and spaced apart from a perimeter of the upper defining the opening;

wherein the tongue has a first set of lace guides extending outward from a perimeter of the tongue;

wherein the upper and has a second set of lace guides extending outward from the perimeter of the upper into the opening; and wherein the first set of lace guides is interleaved with the second set of lace guides when the tongue is positioned adjacent the upper, the tongue being removably attachable to the upper by a lace configured to route through the first set of lace guides and the second set of lace guides to hinge the tongue to the upper at the first set of lace guides and the second set of lace guides.

14. The article of footwear of claim 13, wherein:

the perimeter of the tongue has a front edge;

the upper has front portion partially defining the opening in the instep region; and wherein the first set of lace guides extends outward of the front edge of the tongue, and the second set of lace guides extends outward of the front portion of the upper.

15. The article of footwear of claim 13, wherein the first set of lace guides and the second set of lace guides are tubular loops each having a central opening through which the lace routes.

16. The article of footwear of claim 13, wherein:

the tongue includes a first set of medial lace guides extending outward of a first side edge of the tongue and a first set of lateral lace guides extending outward of a second side edge of the tongue;

the upper includes a second set of medial lace guides extending from a medial side of the upper and interleaved with the first set of medial lace guides and a second set of lateral lace guides extending from a lateral side of the upper and interleaved with the first set of lateral lace guides; and the lace routes through the first and second sets of medial lace guides, and through the first and second sets of lateral lace guides without crossing over the tongue.

17. The article of footwear of claim 16, wherein:

the tongue has alternating peaks and valleys at the first side edge of the tongue, and alternating peaks and valleys at the second side edge of the tongue;

the first set of medial lace guides extends from the peaks of the first side edge of the tongue; and the first set of lateral lace guides extends from the peaks of the second side edge of the tongue.

18. The article of footwear of claim 17, wherein the upper has alternating peaks and valleys at the medial side of the upper, the alternating peaks and valleys at the lateral side of the upper;

the second set of medial lace guides extends from the peaks of the medial side of the upper; and the second set of lateral lace guides extends from the peaks of the lateral side of the upper.

* * * * *